US006227030B1

(12) United States Patent
Lefavour et al.

(10) Patent No.: US 6,227,030 B1
(45) Date of Patent: May 8, 2001

(54) ELECTRICAL CONNECTOR CRIMPING DIE WITH OVER-CRIMP PREVENTION SURFACE AND METHOD

(75) Inventors: John D. Lefavour, Litchfield; Clayton W. Mack, Sanbornton; John W. Ayer, Merrimack, all of NH (US)

(73) Assignee: FCI USA, Inc., Etters, PA (US)

( * ) Notice: Subject to any disclaimer, the term of this patent is extended or adjusted under 35 U.S.C. 154(b) by 0 days.

(21) Appl. No.: 09/465,892

(22) Filed: Dec. 17, 1999

(51) Int. Cl.[7] ..... H01R 43/042

(52) U.S. Cl. ..... 72/416; 72/409.14; 72/453.6; 29/751

(58) Field of Search ..... 72/416, 409.14, 72/409.01, 413, 412, 453.16; 29/751

(56) References Cited

U.S. PATENT DOCUMENTS

| | | | | |
|---|---|---|---|---|
| 3,267,717 | * | 8/1966 | Reischer | 72/416 |
| 3,365,927 | * | 1/1968 | Lynch | 72/416 |
| 4,019,236 | | 4/1977 | Osman | 29/753 |
| 4,292,833 | | 10/1981 | Lapp | 72/416 |
| 5,042,285 | * | 8/1991 | Levy | 72/416 |
| 5,193,379 | | 3/1993 | Ferraro | 72/412 |
| 5,291,772 | | 3/1994 | Ferraro | 72/476 |
| 5,421,186 | * | 6/1995 | Lefavour | 72/416 |
| 5,657,417 | | 8/1997 | Di Troia | 388/829 |
| 6,101,862 | * | 8/2000 | Rzasa | 72/416 |

OTHER PUBLICATIONS

Electrical Master Catalog, The Electrical Connector Selector, Framatome Connectors Burndy Electrical, 4 pages.

* cited by examiner

*Primary Examiner*—Daniel C. Crane
(74) *Attorney, Agent, or Firm*—Perman & Green, LLP

(57) ABSTRACT

An electrical connector crimping die comprising a first section for removably connecting the die to an electrical connector compression tool; and a second section connected to the first section for contacting an electrical connector. The second section comprises a generally crescent shaped crimp projection forming a crimp surface and at least one secondary over-crimp prevention surface. The secondary surface is recessed relative to the crimp surface and has a general radius of curvature larger than a general radius of curvature of the crimp surface.

12 Claims, 3 Drawing Sheets

ELECTRICAL CONNECTOR CRIMPING DIE WITH OVER-CRIMP PREVENTION SURFACE AND METHOD

BACKGROUND OF THE INVENTION

1. Field of the Invention

The present invention relates to electrical connectors and, more particularly, to a die used to crimp an electrical connector onto an electrical conductor.

2. Prior Art

U.S. Pat. No. 5,291,772 discloses a compression tool ram with an electrical connector crimping surface having a pyramid shaped section and two flat sections on opposite sides of the pyramid shaped section. The flat sections are provided to prevent over-crimping of the electrical connector. FCI USA, Inc. sells electrical connector crimping dies known as "W" type dies. The "W" type dies form a general circumferential crimp around a barrel section of the electrical connector. The "W" type of dies are installed primarily in what is known as an industry "D3" die retaining groove.

The D3 groove is very common in mechanical hand held crimp tools such as the MD6 HYTOOL™ as well as hydraulic Tools such as the BAT500 BATOOL™ sold by FCI USA, Inc. The D3 groove can accommodate various "W" dies and hence can crimp a multitude of conductor/connector size combinations. The crimp range of the "W" die using a circumferential crimp profile is often limited to 500 kcmil Copper and 4/0 Aluminum for hydraulic tools. The need to expand the range for aluminum has become evident in the underground residential distribution market. More specifically, there is a desire to use tools which use "W" dies which are capable of crimping an electrical connector onto a relatively large 350 kcmil size aluminum conductor; which is not possible with conventional "W" dies.

SUMMARY OF THE INVENTION

In accordance with one embodiment of the present invention, an electrical connector crimping die is provided comprising a first section for removably connecting the die to an electrical connector compression tool; and a second section connected to the first section for contacting an electrical connector. The second section comprises a generally crescent shaped crimp projection forming a crimp surface and at least one secondary over-crimp prevention surface. The secondary surface is recessed relative to the crimp surface and has a general radius of curvature larger than a general radius of curvature of the crimp surface.

In accordance with another embodiment of the present invention, an electrical connector hydraulic crimping tool for crimping an electrical connector onto a conductor is provided comprising a hydraulic drive section generally adapted to provide a maximum hydraulic crimping force of between about 6 to 7 tons; and an electrical connector crimping die connected to the drive section for movement by the drive section towards a cooperating crimping die. The electrical connector crimping die comprises a crimping projection with a width of about 0.25 inch and a height of about 0.045 inch for crimping the electrical connector onto the conductor without piercing through the connector, and wherein the conductor has a size of about 350 kcmil.

In accordance with one method of the present invention, a method for crimping an electrical connector onto a 350 kcmil aluminum electrical conductor is provided comprising steps of providing a hydraulic compression tool with a crimping die, the tool having a maximum hydraulic crimping force of about 6 to 7 tons, and the crimping die having a crimping projection and secondary over-crimp prevention surfaces on opposite sides of the crimping projection, the over-crimp prevention surfaces having curved surfaces with a radius of curvature about the same as an outer dimension of a barrel section of the electrical connector; and compressing the crimping die against the electrical connector with the crimping projection deforming the electrical connector and the over-crimp prevention surfaces subsequently contacting the electrical connector to prevent the crimping projection from penetrating through the connector or causing the connector to crack. The crimping projection deforms the connector inward at least about 0.045 inch along a width of at least about 0.25 inch without overcrimping the electrical connector.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
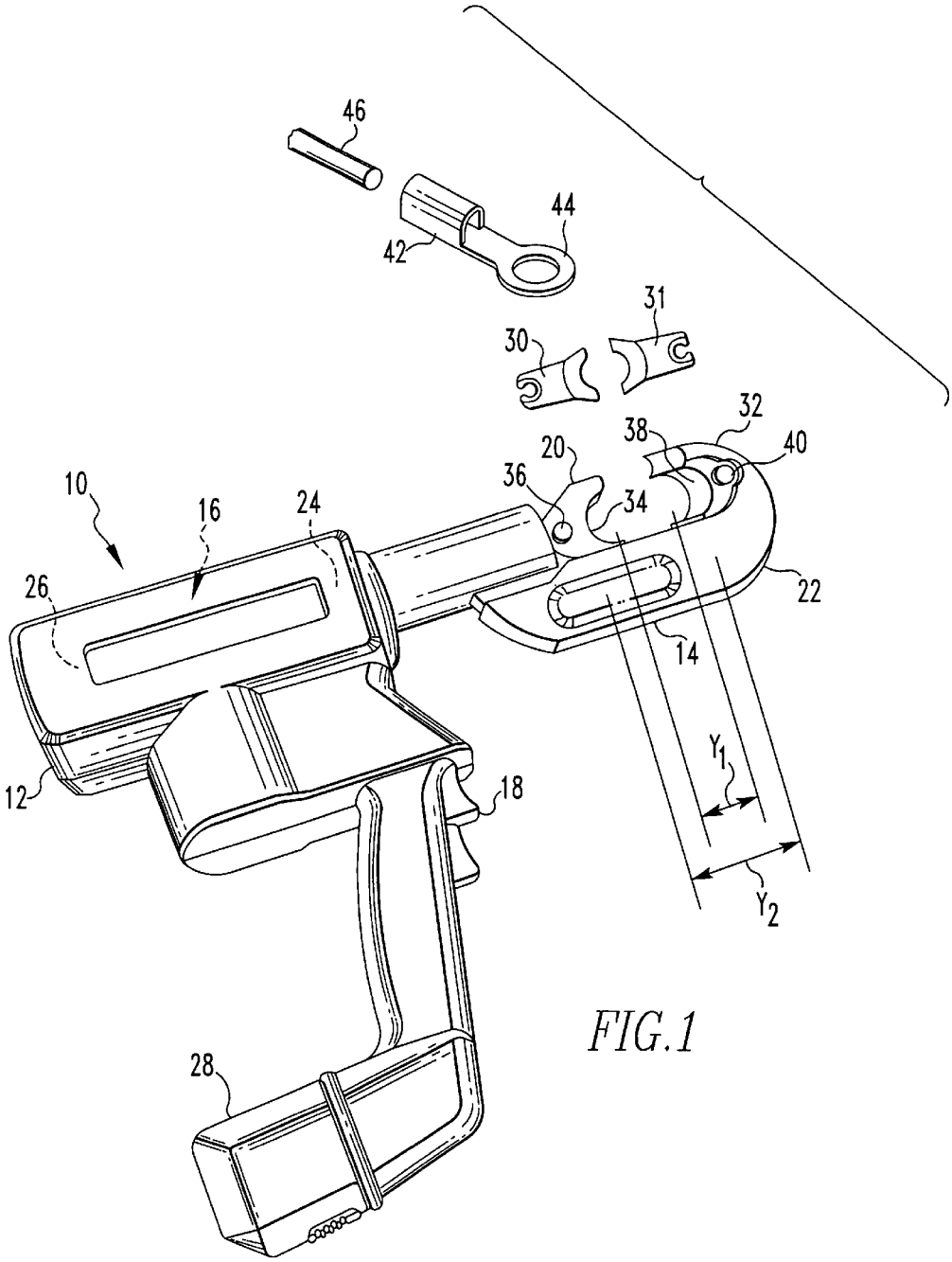
FIG. 1 is a perspective view of a hydraulic electrical connector crimping tool, a pair of crimping dies incorporating features of the present invention, an electrical connector and a portion of an electrical conductor.
Figure 2A:
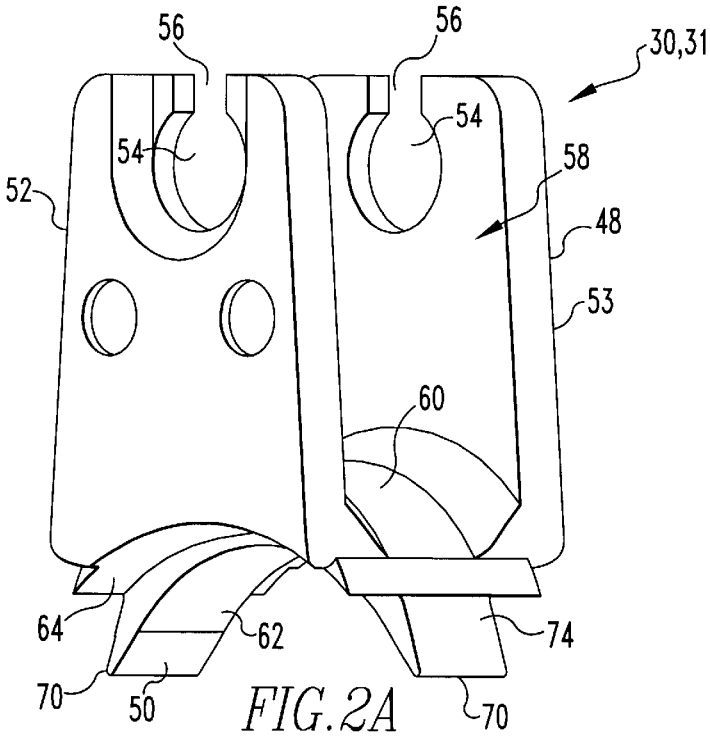
FIGS. 2A and 2B are perspective views of one of the crimping dies shown in FIG. 1.
Figure 2B:
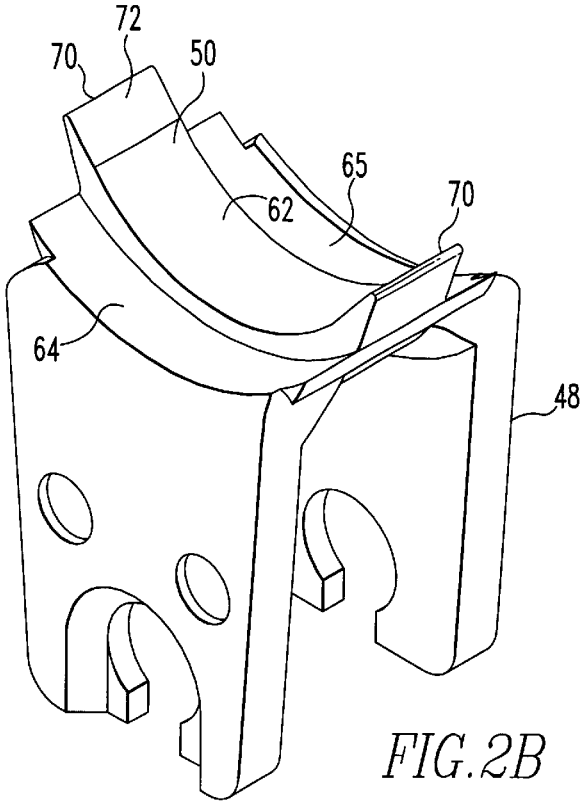
Figure 2C:
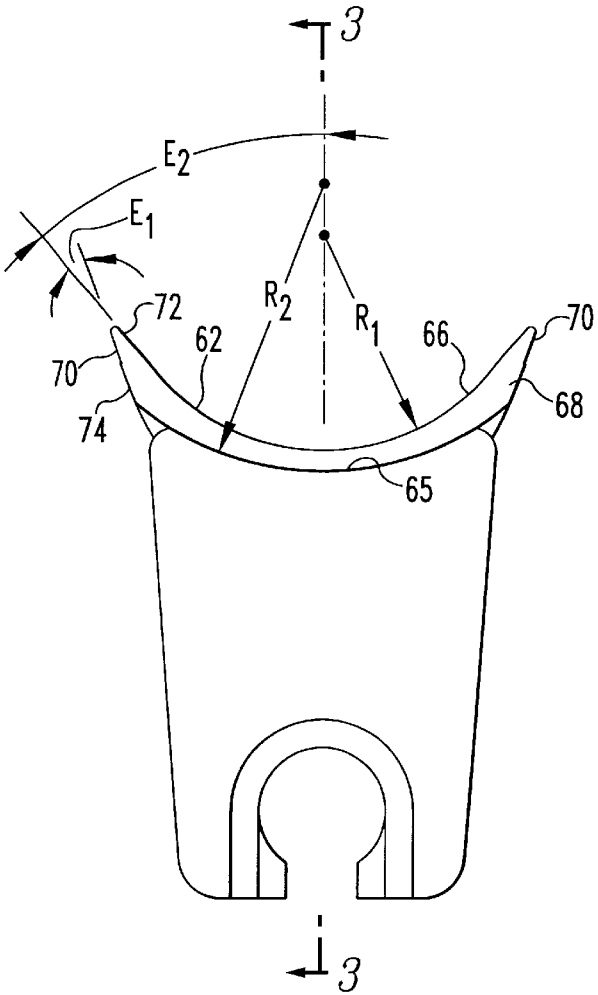
FIG. 2C is an elevational side view of the crimping die shown in FIG. 2A.
Figure 3:
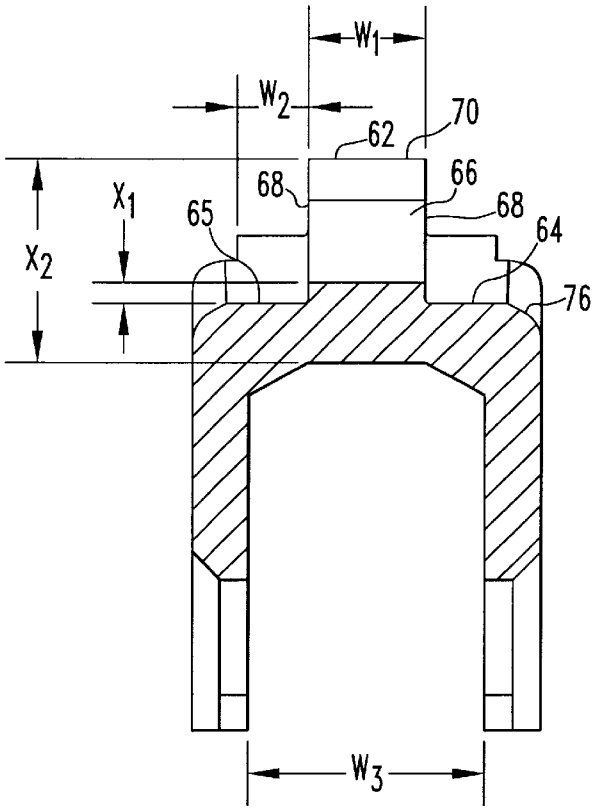
FIG. 3 is a cross-sectional view of the crimping die shown in FIG. 2C taken along line 3—3.

Referring to FIG. 1, there is shown a perspective view of a hydraulic electrical connector crimping tool 10 incorporating features of the present invention. Although the present invention will be described with reference to the single embodiment shown in the drawings, it should be understood that the present invention can be embodied in many alternate forms of embodiments. In addition, any suitable size, shape or type of elements or materials could be used.

The tool 10 generally comprises a housing 12, a compression head 14, a drive system 16, and a control system 18. The compression head 14 is a well known part of crimping tools and includes a spring loaded ram 20 and a frame 22. A similar tool is disclosed in U.S. Pat. No. 5,657,417 which is hereby incorporated by reference in its entirely. Removable crimping dies 30, 31 are connected to the tool 10.

The drive system 16 generally comprises a hydraulic pressure system with a pump 24, an electric motor 26, and a battery 28. The drive system 16 is adapted to move the ram 20 towards the opposite portion 32 of frame 22 with a spring being capable of returning the ram 20 to a retracted home position when the drive system 16 is deactuated. The ram 20 includes a D3 groove 34 and a spring loaded "W" die retainer button 36. The opposite portion 32 of the frame 22 also includes a D3 groove 38 and a spring loaded "W" die retainer button 40. The ram's D3 groove 34 and retainer button 36 are generally adapted to removably mount the first die 30 to the ram 20. The frame's D3 groove 38 and retainer button 40 are generally adapted to removably mount the second die 31 to the frame 22. The tool 10 can accept any suitable type of "W" die including the new "W" type of dies 30, 31 described in more detail below with reference to FIGS. 2A–2C and 3. The tool 10 is generally adapted to compress or crimp a barrel section 42 of an electrical connector 44 onto an electrical conductor 46. More specifically, with the use of the new dies 30, 31, the barrel section 42 can be sized to receive a 350 kcmil size aluminum conductor 46 and circumferentially crimp the barrel section 42 on the 350 kcmil size conductor 46. In alternate embodiments the dies 30, 31 could be used with any suitable type of connector crimping tool; not merely the tool 10 described above.

Referring now also to FIGS. 2A, 2B, 2C and 3, the two dies 30, 31 are substantially identical and, thus, only one will be described. However, in alternate embodiments the two dies 30, 31 could be different. The dies each generally comprise a first section 48 and a second section 50. The first section 48 is generally provided for removably connecting the die to one of the D3 grooves and retainer buttons and has a conventional "W" type die shape for this purpose. More specifically, the first section 48 generally comprises two spaced legs 52, 53. Each leg 52, 53 comprises a button receiving area 54 and a lead-in 56. The two legs 52, 53 extending from a rear end of the second section 50 in a general cantilever fashion. The legs 52, 53 are sized and shaped to be received within a conventional D3 groove. The legs 52, 53 form a receiving area 58 therebetween for receiving a portion of the ram 20 or frame 22 and locating the received portion in the area behind the second section 50; against the rear surface 60 of the second section 50. The receiving area 58 has a width $W_3$ (see FIG. 3). In a preferred embodiment the width $W_3$ is about 0.5 inch. However, any suitable width could be provided.

The second section 50 generally comprises a primary crimp projection 62 and two secondary over-crimp prevention surfaces 64, 65. In an alternate embodiment only one secondary over-crimp prevention surface need be provided. In this embodiment, the two over-crimp prevention surfaces 64, 65 are located on opposite sides of the crimp projection 62. The primary crimp projection 62 generally comprises a top crimp surface 66, lateral side surfaces 68 extending generally perpendicular from the top surface 66, and two end extensions 70. In an alternate embodiment the lateral side surfaces 68 could extend between the top surface 66 and over-crimp prevention surfaces 64, 65 at an inclined angle or have curvatures rather than flat surfaces. The primary crimp projection 62 has a width $W_1$. In a preferred embodiment the width $W_1$ is about 0.25 inch. However, any suitable width could be provided. The top crimp surface 66 is curved along a majority of its length with a radius of curvature $R_1$ except at the two end extensions 70. In a preferred embodiment $R_1$ is about 0.46 inch. However, any suitable shape(s) could be provided. In addition, the top surface 66 need not be uniformly curved, but could have a series of angles flat surfaces, similar to sides to a polygon. The two end extensions 70 have general wedge shaped profiles with an angle $E_1$ between top and bottom surfaces 72, 74. In a preferred embodiment the angle $E_1$ is about 23°. However, any suitable angle could be provided. In this embodiment both surfaces 72, 74 are substantially flat. However, any suitable shape(s) could be provided. The top end extension surfaces 72 extend from opposite ends of the main curved section of the top surface 66 and are angled relative to a center axis of the die at an angle $E_2$. In a preferred embodiment the angle $E_2$ is about $_{40}$°. However, any suitable angle could be provided. The height $X_2$ between the top of the end extensions 70 and the bottom of the center of the second section 50 is preferably bout 0.45 inch and the distance between the tips of the end extensions 70 is preferably about 0.80 inch. However, any suitable dimensions could be provided. In this embodiment the dies 30, 31 are designed to be non-butting dies. In other words, when the tool 10 crimps the connector 44 onto the conductor 46 the end extensions 70 of the two opposing dies 30, 31 do not contact each other. The dies 30, 31 are designed to crimp the connector 44 onto the conductor 46 without over crimping and without contacting each other by increasing areas of contact between the dies and the connector after a predetermined deformation of the connector has occurred and using the tool's hydraulic pressure relief system (maximum hydraulic pressure) to stop further crimping; thereby preventing over-crimping. As further described below, in the preferred embodiment the increase in area of contact is a stepped progression.

The two over-crimp prevention surfaces 64, 65 are substantially the same, but could be different. Each surface 64, 65 has a uniform curvature with a radius of curvature $R_2$. In a preferred embodiment $R_2$ is about 0.62 inch. However, any suitable radius of curvature could be provided. In addition, one or both of the surfaces 64, 65 need not have a uniform curvature or could comprise any suitable surface, such as a series of angled flats, similar to sides of a polygon. In the preferred embodiment the radius of curvature $R_2$ is about the same as the radius of curvature of the outside surface of the barrel section 42 of a connector 44 for the 350 kcmil aluminum conductor 46 (i.e.: about 0.62 inch). The surfaces 64, 65 are located below or recessed from the surface 66 at the center of the die by a distance $X_1$. In a preferred embodiment the distance $X_1$ is about 0.045 inch. However, any suitable height could be provided. The surfaces 64, 65 have a width $W_2$ of about 0.2 inch and a curved surface 76 to the lateral sides of the die. However, any suitable width of the surfaces 64, 65 or transition of the surfaces 64, 65 to the lateral sides of the die could be provided. Because of the two different radii of curvatures $R_1$ and $R_2$ and the shape of the end extensions 70, the crimp projection 62 has a general crescent side profile as seen best in FIG. 2C. Because $R_1$ is less than $R_2$ the shape is not an exact crescent, but the shape of the end extensions help to transform the shape into a general crescent shape.

As noted above, the dies 30, 31 provide a general stepped progression between deformation of the connector 44 by the crimp projection 62 and subsequent over-crimp prevention. This occurs by providing a substantial increase in resistance to further deformation when the over-crimp prevention surfaces 64, 65 initially contact the conductor. In order to maximize the transition and maximize prevention of over-crimping with the limited amount of surface area available, the present invention provides the surfaces 64, 65 with about the same radius of curvature as the barrel section 42 of the connector. The tool 10 is preferably a conventional tool and the amount of space between the ram 20 and the opposite portion 32 is limited, such as only about 0.60 inch for $Y_1$ and 1.52 inch for $Y_2$ (see FIG. 1). Thus, the dies 30, 31 of the present invention have been specifically designed to connect to the tool 10 in the limited space between the ram 20 and the opposite portion 32, but still allow circumferential crimping of a connector barrel on a 350 kcmil AL conductor. Thus, the dies 30, 31 maximize use of the space between the ram 20 and opposite portion 32 through the unique design of the second section 50. In addition, the unique design of the second section maximizes support for the second section 50 on the D3 grooves 34 and 38 to prevent the second section 50 from being bent during repeated use. More specifically, the width $W_1$ of the crimp projection 62 should not be wider than about 0.25 inch; otherwise the backside of its edges will not be supported by the material of the D3 groove.

The present invention provides a "W" type of die set with a circumferential crimp profile for use on 350 kcmil aluminum conductor/connectors, primarily for use in hydraulic crimp tools that have an output force of 6–7 short tons (but no limited to). The subject dies are crescent shaped, thus, partially filling the D3 groove. The crescent profile establishes a crimp surface for compression. The crimp surface has a radius smaller than that of the connector barrel. In addition, the die features two secondary surfaces of larger radius than the crimp surface. The secondary surface has a matching radius to that of the 350 kcmil connector barrel, thus providing sufficient contact area to control the depth of crimp.

In the past, larger output capacity hydraulic crimp tools have been used to crimp 350 kcmil Aluminum connectors/conductors. Tools such as the Y750 HYPRESS™ series and BAT35 BATOOL™ series. Most tools that use a circumferential crimp profile to crimp 350 kcmil aluminum have been 12 short tons or larger tools. Traditionally the circumferential dies are non-butting and have sufficient crimp area so that the tool die holders or die sets never contact each other when crimping. The resulting crimp dimension is highly dependent on the output force of the tool and contact area of the die. When the tool reaches full output force, a valve internal to the hydraulic tool relieves pressure and output force, thus establishing the crimp dimension.

The invention described above was designed to produce a crimp dimension as close as possible to that of traditional 12 Short Ton tools, but using a circumferential "W" die profile in a 6–7 Short Ton tool. To design such a "W" die the "W" die crimp area had to be reduced to something much less than the traditional non butting dies as used in the 12 ton tools (a width of about 0.43 inch). However, when designing a "W" die it is difficult to design to a desired crimp width of 0.430 inch (as calculated to simulate performance of a 12 short ton tool) Difficulties arise because the die would be scalloped shaped and, there would be insufficient material to support the geometry of the die when crimping. The die would bend. Thus, the actual crimp width of the present invention is reduced to that of approximately equal to the die holder to adequately support the die geometry. However, reducing the width of the crimp projection 62 to less than the conventional 0.43 inch width for a 350 kcmil conductor/connector die results in another problem. In particular, the relatively small width $W_1$ would be too small to stop the crimping deformation before over-crimping occurs. More specifically, the reduced width crimping projection would penetrate into the connector barrel 42 or cause the barrel to crack. In order to overcome this problem, the over-crimp prevention surfaces 64, 65 were added slightly behind the crimp projection 62. The secondary surfaces 64, 65 provide a large contact area with the connector. The secondary surfaces permits the 6–7 short ton tool to reach full output force without over-crimping. With conventional 12 short ton tools and conventional 350 kcmil connector/conductor dies, it is usually necessary to crimp the connector barrel two times onto the conductor to form a connection with adequate pull-out resistance. With the dies 30, 31, it may be necessary to crimp three or more times, but the user can use a 6–7 short ton tool which he may already have, rather than having to perhaps buy a new 12 short ton tool.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector crimping die comprising:

a first section for removably connecting the die to an electrical connector compression tool; and a second section connected to the first section for contacting an electrical connector, the second section comprising a generally crescent shaped crimp projection forming a crimp surface and at least one secondary over-crimp prevention surface, the secondary surface being recessed relative to the crimp surface and having a general radius of curvature larger than a general radius of curvature of the crimp surface.

2. A crimping die as in claim 1 wherein the first section comprises two spaced legs, each leg comprising an aperture for receiving a spring loaded die retainer on a hydraulic compression tool.

3. A crimping die as in claim 1 wherein the second section comprises two of the secondary over-crimp prevention surfaces located on opposite of the crimp projection.

4. A crimping die as in claim 1 wherein the first section comprises a receiving area for receiving a portion of a compression tool in an area behind the second section, wherein a width of the crimp projection is less than a width of the receiving area.

5. A crimping die as in claim 4 wherein the width of the crimp projection is about 0.25 inch.

6. A crimping die as in claim 1 wherein the crimp surface comprises a general concave curved shape.

7. An electrical connector hydraulic crimping tool for crimping an electrical connector onto a conductor, the crimping tool comprising:

a hydraulic drive section generally adapted to provide a maximum hydraulic crimping force of between about 6 to 7 tons; and an electrical connector crimping die connected to the drive section for movement by the drive section towards a cooperating crimping die, wherein the electrical connector crimping die comprises a crimping projection and at least one over-crimp prevention surface on a side of the crimping projection, wherein the crimping projection comprises a width of about 0.25 inch and a height of about 0.045 inch for crimping the electrical connector onto the conductor without piercing through the connector, wherein the at least one over-crimp prevention surface is recessed relative to the crimping projection, and wherein the conductor has a size of about 350 kcmil and the at least one over-crimp prevention surface is curved with about a same radius of curvature as a barrel section of the electrical connector.

8. A crimping tool as in claim 7 wherein the crimping projection comprises a general crescent shape.

9. A crimping tool as in claim 8 wherein the crescent shape comprises a concave curved crimping surface.

10. A crimping tool as in claim 7 wherein the crimping die comprises a receiving area behind the crimping projection with a portion of the hydraulic drive section located in the receiving area, wherein a width of the receiving area is larger than the width of the crimping projection.

11. A crimping tool as in claim 7 wherein the crimping die comprises at least two of the over-crimp prevention surfaces on opposite sides of the crimping projection.

12. A method for crimping an electrical connector onto a 350 kcmil aluminum electrical conductor comprising steps of:

providing a hydraulic compression tool with a crimping die, the tool having a maximum hydraulic crimping force of about 6 to 7 tons, and the crimping die having a crimping projection and secondary over-crimp prevention surfaces on opposite sides of the crimping projection, the over-crimp prevention surfaces having curved surfaces with a radius of curvature about the same as an outer dimension of a barrel section of the electrical connector; and compressing the crimping die against the electrical connector with the crimping projection deforming the electrical connector and the over-crimp prevention surfaces subsequently contacting the electrical connector to prevent the crimping projection from penetrating through the connector or causing the connector to crack, wherein the crimping projection deforms the connector inward at least about 0.045 inch along a width of at least about 0.25 inch without over-crimping the electrical connector.

* * * * *